United States Patent [19]

Robinson

[11] Patent Number: 4,509,749

[45] Date of Patent: Apr. 9, 1985

[54] TENNIS NET TIE DOWN AND HEIGHT MEASUREMENT DEVICE

[76] Inventor: Philip I. Robinson, 23608 Clover Trail, Calabasas, Calif. 91302

[21] Appl. No.: 101,414

[22] Filed: Dec. 10, 1979

[51] Int. Cl.[3] ..... A63B 61/00

[52] U.S. Cl. ..... 273/29 BA

[58] Field of Search ..... 273/29 BA, 29 B, 29 R; 33/178 B, 176, 163; D10/64, 70, 71

[56] References Cited

U.S. PATENT DOCUMENTS

| | | | |
|---|---|---|---|
| D. 249,336 | 9/1978 | Webb | D10/64 |
| 494,913 | 4/1893 | Booth | 273/29 BA |
| 1,534,447 | 4/1925 | Hardy | 273/29 BA |
| 1,551,100 | 8/1925 | Graham | 273/29 BA |
| 4,205,841 | 6/1980 | Blevins | 273/29 BA |

FOREIGN PATENT DOCUMENTS

| | | | |
|---|---|---|---|
| 322644 | 12/1929 | United Kingdom | 273/29 BA |
| 516402 | 1/1940 | United Kingdom | 273/29 BA |

*Primary Examiner*—Richard C. Pinkham
*Assistant Examiner*—T. Brown
*Attorney, Agent, or Firm*—Harry B. Field

[57] ABSTRACT

A dual purpose tennis net tie down and height setting device 14 comprises a top hook 16 for attaching to the upper edge 18 of tennis net 12. Depending from the top hook 16 is tie down chain 20 which connects in parallel with bottom hook 26 and a height refinement turnbuckle 32. By joining bottom hook 26 and chain 20 in parallel, the bottom hook 26 may be adjusted to correct for deviations in the depth of tie down fitting 24 without altering the distance between top hook interior 22 and the bottom of the last chain link 30.

1 Claim, 8 Drawing Figures

Fig. 1
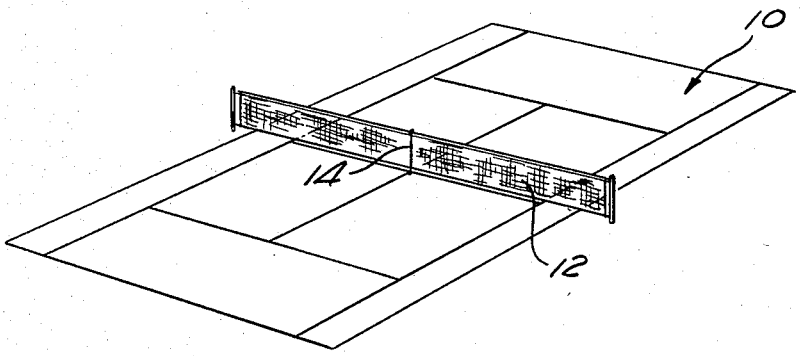
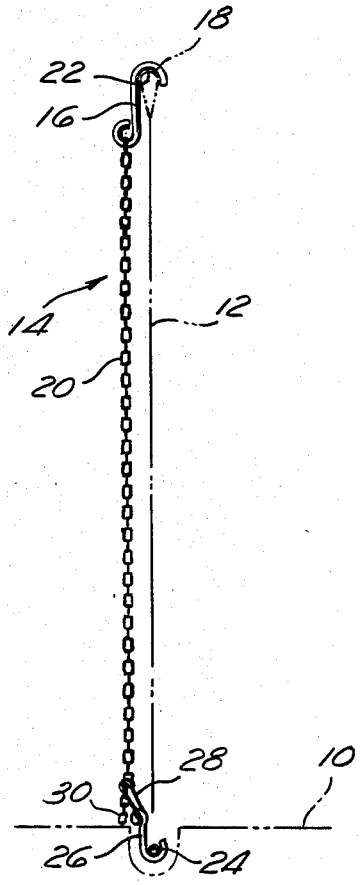
Fig. 2a
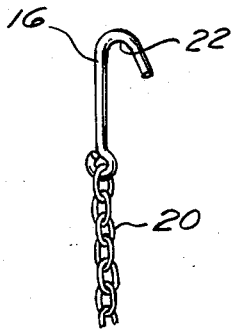
Fig. 2b
Fig. 2c
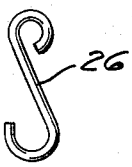
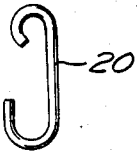
Fig. 2d
Fig. 4
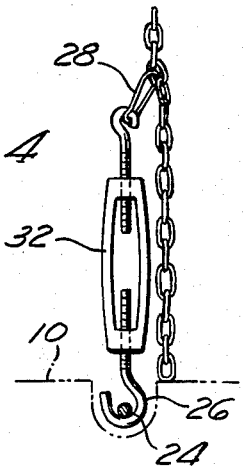
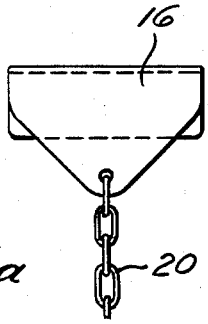
Fig. 3a
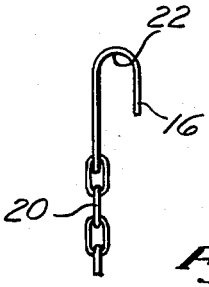
Fig. 3b

TENNIS NET TIE DOWN AND HEIGHT MEASUREMENT DEVICE

BACKGROUND OF THE INVENTION

1. Field of the Invention

This invention pertains to tennis equipment and more specifically to tennis net tie down and height measuring devices.

2. Description of the Prior Art

Today many players are using public courts where it is impractical to leave the traditional adjustable tie-down strap. Also very few players carry with them a measuring device for net height. Racket length and width is sometimes used, but is undependable since racket shapes vary widely today. An easily carried, accurate "yard stick" for tennis net center height control is especially important for "public court" players.

Various devices have been devised for either measuring net height or for tieing down a tennis net. One such device is depicted in U.S. Design Pat. No. D249,336; however, that device is merely a universal net height measuring device and has no provisions for adjustable tie down. Although the traditional adjustable tie down strap has means for both tieing down the net and adjusting net height, it is an in-line adjustment device, and as such has no self contained height measuring capability and has no way to adjust for variations in distance from the tie down fitting to the court surface. Furthermore, the traditional tie down strap is made from a fabric material which quickly stretches and deteriorates in adverse weather conditions.

SUMMARY OF THE INVENTION

Accordingly, there is provided by the present invention a tennis net tie down and height setting device. The subject invention comprises a top hook for attaching to the upper edge of a tennis net, a measuring and tie down chain for connecting to said top hook, and a bottom hook for joining the chain to an existing tennis court tie down fitting. When properly positioned, the bottom link of the chain will just touch the tennis court surface, thus insuring that the upper edge of the tennis net is thirty-six inches (36") above the court surface.

OBJECTS OF THE INVENTION

Therefore, it is an object of the invention to provide a tennis net tie down and measurement device.

Another object of the present invention is to provide a tennis net tie down and height measurement device which can be easily carried by a player.

Still a further object of the present invention is to provide a tennis net tie down and measurement device which will not be adversely affected by various environmental conditions.

Other objects and many of the attendant advantages of this invention will be readily appreciated as the same becomes better understood by reference to the following detailed description when considered in connection with the accompanying drawings.

BRIEF DESCRIPTION OF THE DRAWINGS

FIG. 1 is a pictorial representation of a tennis court and net having an installed tennis net tie down and height measuring device.

FIG. *2a* is a side schematic representation of the tennis net tie down and height measuring device.

FIG. *2b* is a perspective view of one style of top hook for the right height net set.

FIG. *2c* is a schematic representation of an "S" shaped bottom hook.

FIG. *2d* is a schematic representation of a "C" shaped bottom hook.

FIG. *3a* is a schematic representation of a front view of a second possible top hook.

FIG. *3b* is a schematic representation of a side view of a second possible top hook.

FIG. 4 is a schematic representation of a tie down having a turnbuckle improvement.

DESCRIPTION OF THE PREFERRED EMBODIMENTS

Referring now to FIG. 1 there is shown a pictorial representation of tennis court 10 and net 12 having an installed and functioning tennis net tie down and height measuring device 14.

The tennis net tie down and height measuring device 14, FIG. *2a*, is a dual function device which comprises a top hook 16 for attaching to the upper edge 18 of net 12. Top hook 16 may basically comprise any material which will not be subject to weather deterioration or excessive thermal expansion or contraction in a temperature range of about 10° to about 120° F. Appropriate materials include metals, relatively high strength polymers, and fiberglass. It should also be noted that top hook 16 may have any basic configuration provided that it will not interfere with play by significantly extending above the top edge 18 of net 12. A preferred top hook 16 configuration is shown in FIGS. *3a* and *3b* wherein a sheet stock like material is used. This has the effect of distributing the tensional forces on the net across a larger area, decreasing net wear, and providing for a thinner top hook 16.

A chain or cable 20 of fixed length is affixed to top hook 16 by any nondeteriorating means so that the distance from the top hook interior 22 to the court surface 10 is thirty-six inches (36"). Like top hook 16, chain 20 may comprise any material which will not be subject to weather deterioration or excessive thermal expansion or contraction during the extremes of playing temperatures. Appropriate materials include metals, relatively high strength polymers and fiberglass. The combination of top hook 16 and chain 20 provide a reliable measure, of a stable material, which is light, collapsible, and easily carried by the average player. Although a chain 20 is preferred, any means for connecting the top hook 16 to bottom hook 26 is adequate provided the connecting means 20 complies with the above environmental condition requirements and provides means for attaching said connecting means 20 to the bottom hook 26 in parallel.

Thirty-six inches (36") is the regulation center height for tennis nets; however, tie down fittings 24 vary in height from the court surface 10 so a fixed length tie down will not provide the desired effect. Therefore, an adjustable bottom hook 26 must be provided. By way of example and not limitation, bottom hook 26 can be made adjustable either by adding spring clip 28 or by design as shown in FIGS. *2c* and *2d*. In operation, bottom hook 26 engages tie down fitting 24 and either spring clip 28 or bottom hook 26 itself engages chain 20 near the bottom so that the last link 30 of chain 20 just touches the court surface 10.

Both the measuring means and tie down mechanism can be enhanced by the addition of a height refinement mechanism such as a turnbuckle 32. Without the use of turnbuckle 32, or other height refinement means, the height of the net could be off by the length of half of a chain link. However, turnbuckle 32 will permit extremely accurate net height adjustments. Furthermore, turnbuckle 32 could be attached directly to chain 20 thereby decreasing the overall cost of the item as well as further simplifying the device. As with top hook 16 and chain 20 bottom hook 26 and hook connectors may comprise any material which will not be subject to weather deterioration or excessive thermal expansion or contracting during the extremes of playing temperatures.

No matter what adjustment mechanism or bottom hook 26 is used for the subject invention it is important to note that it may not be an in-line adjuster since that would result in impermissibly varying the distance from the top hook 16 to the court surface 10. Since the purpose of the adjuster, bottom hook 26, is to correct for variations in the depth of the tie down fitting 24 while concurrently maintaining a thirty-six inch (36″) chain length, it should always be installed in parallel with the tie down chain 20 as shown in FIGS. 2*a* and 4.

Obviously, many modifications and variations of the present invention are possible in light of the above teachings. It is therefore to be understood that, within the scope of the appended claims, the invention may be practiced otherwise than as specifically described.

What is new and desired to be secured by Letters Patent of the United States is:

1. A tennis net tie down and height setting device, comprising:

a top hook, for attaching to the upper edge of a tennis net;

a measuring and tie down means for connecting to said top hook; and a height refinement mechanism, comprising a turnbuckle and a bottom hook connected in parallel with said measuring and tie down means for joining said measuring and tie down means to an existing tennis court tie down fitting so as to insure that said upper edge of said tennis net is thirty-six inches (36″) above the court surface.

* * * * *